United States Patent [19]

Johnson

[11] 4,081,055

[45] Mar. 28, 1978

[54] HYDRAULIC DEVICE FOR CONTROLLING THE PERPENDICULARITY OF BOOM MEMBERS IN MOBILE PLATFORMS

[75] Inventor: Leonard L. Johnson, Fort Wayne, Ind.

[73] Assignee: Teco, Inc., Fort Wayne, Ind.

[21] Appl. No.: 761,730

[22] Filed: Jan. 24, 1977

[51] Int. Cl.[2] ..... B66F 11/04

[52] U.S. Cl. ..... 182/2; 182/19; 212/39 A

[58] Field of Search ..... 182/2, 19, 46; 212/39 A, 39 R

[56] References Cited

U.S. PATENT DOCUMENTS

| | | | |
|---|---|---|---|
| 2,616,768 | 11/1952 | Stemm | 182/2 |
| 3,035,710 | 5/1963 | Pohl | 182/19 |
| 3,082,842 | 3/1963 | Balogh | 182/2 |
| 3,094,221 | 6/1963 | Galuska | 212/39 A |
| 3,747,148 | 7/1973 | Hitchcock | 182/2 |

*Primary Examiner*—Reinaldo P. Machado
*Attorney, Agent, or Firm*—John A. Young

[57] ABSTRACT

In connection with a pair of articulated booms there is a leveling system consisting of a sprocket wheel at the base of the lower boom and a co-acting sprocket wheel at the free end of the upper boom with chains and rods interconnecting the two sprockets and constituting part of the leveling system maintaining the basket connected to the free end of the upper boom in a level condition.

The angular position of the sprocket wheel on the upper boom is calibrated so as to be in a direct relationship to the perpendicularity of the upper boom relative to the horizon, which in turn is related to chain movement at the upper boom.

A control valve associated with the upper boom is actuated by a cam on the chain so the valve is operated at whatever preselected critical angle of perpendicularity of the upper boom is desired. The control valve, in turn, has fluid connections with power actuator means associated with each of the upper and lower booms to preclude further movement of either the upper or lower boom which would increase the perpendicularity of the upper boom beyond its critical predetermined amount. Fluid connections are provided to the power actuator means associated with the upper and lower booms to permit either or both of the booms to be actuated in a direction decreasing the perpendicularity of the upper boom from its critical position whether the control valve has been operated or not.

6 Claims, 7 Drawing Figures

HYDRAULIC DEVICE FOR CONTROLLING THE PERPENDICULARITY OF BOOM MEMBERS IN MOBILE PLATFORMS

BACKGROUND OF THE INVENTION

Articulated booms having a vertically movable platform are mounted on trucks and the like. These articulated booms must be provisioned for stable operation of the booms in order that the booms, and the weight they carry, do not cause overbalancing of the vehicle, and also to prevent positioning of either boom in such a location as to make it unstable and unsafe for the occupant of a basket located at the free end of the upper one of the articulated booms.

There are controls available which have an overriding effect on the power actuators associated with the upper and lower booms respectively which are intended to prevent the boom and its associated platform from approaching an unstable position when the basket is brought forward or into an over center position. The unstable position for the upper boom is the position in which the upper boom is either vertical in reference to the horizon, or nearly vertical. At this position, the articulated boom system is unstable and should the upper boom move beyond center, or into an "over center" position relative to the lower boom, the weight in the basket is most likely to cause an overbalancing of the truck.

The systems which have been proposed for correcting perpendicularity of the upper boom and an over center movement of the upper boom, are for the most part based on the concept of disabling the hydraulic system to prevent further articulated boom actuation and the booms are then returned to a stable position by controls at ground level. While this is at least a partial answer to the problem, it is still not wholly satisfactory since, what is needed, is to prevent the upper boom from moving into the unstable position in the first instance, by providing an overriding actuator means which will prevent the operator from using the controls at the basket level to effect unstable boom positions. Moreover, if by inadvertence or lack of skill, the operator does use the basket controls for actuating the basket and there results an unstable position for the upper boom, the controls at the basket level should remain operative at least to the extent of obtaining the necessary correctional movement of the booms to bring them back into a stable condition.

OBJECTS OF THE INVENTION

It is an object of the present invention to provide an overriding control which precludes the boom actuator system from bringing the upper boom into an unstable condition and which will nevertheless permit the controls at the basket level to be utilized for boom actuation to counterrotate the booms into a stable condition even if such overriding control has operated.

Another object of the present invention is to provide, in conjunction with an actuator system for articulated booms, a distinct actuator one for the upper and a second for the lower boom, and means for preventing movement of the upper boom beyond a certain degree of perpendicularity whether such movement occurs by reason of the upper or lower boom movement but without in any way interfering with movement of the upper or lower booms in a direction reducing the upper boom perpendicularity.

Another object of the present invention is to provide a novel means for determining the perpendicularity of the upper boom, such means being operative through the leveling system for the basket at the end of the articulated booms and which can be readily calibrated for a given configuration of articulated booms to effect deactuation of further movements which would bring the upper boom in excess of the desired perpendicularity relative to the horizon.

An important feature of the present invention is that although the upper boom is prevented from moving beyond a certain degree of perpendicularity, this in no way interferes with the ability of the actuator system to countermove the upper or lower boom in a direction reducing the perpendicularity all of which controllability continues at the basket level by the operator.

Another important feature of the invention is that by means of a single, simplified valve mechanism which is responsive to both upper and lower boom movements there is a constant monitoring of the perpendicularity of the upper boom, and such can be accomplished in a simple manner which can be readjusted from time to time, if desired, to change; and, once changed, fix the upper limit of the upper boom in a perpendicular sense.

Other objects and features of the present invention will become apparent from a consideration of the following description which proceeds with reference to the accompanying drawings.

DRAWINGS

DETAILED DESCRIPTION OF THE INVENTION

Figure 1:
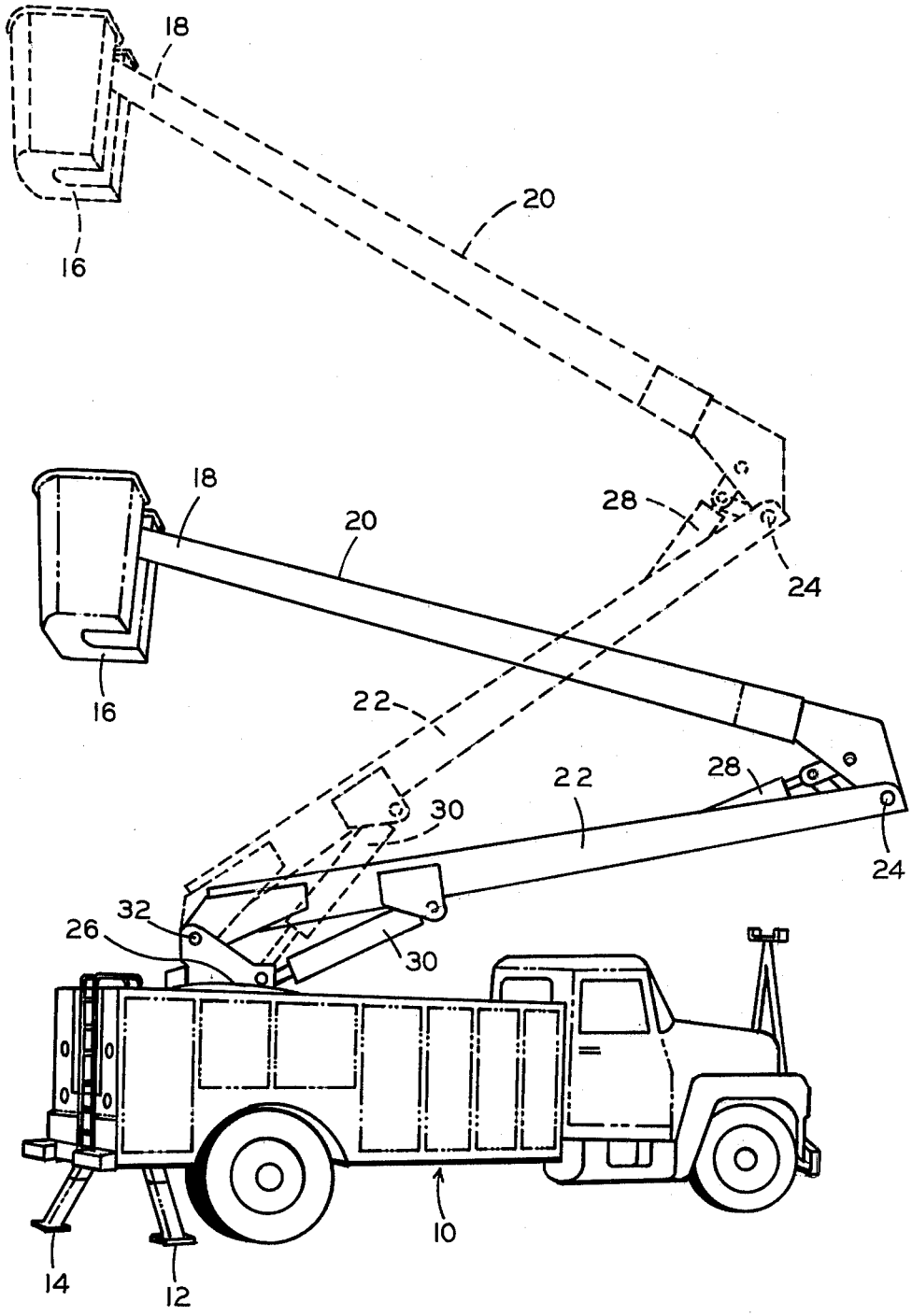
FIG. 1 shows a mobile articulated tower having a basket or lift platform at one end thereof, its articulated booms being in one position shown in full line and a second position shown in dotted line.

Referring to FIG. 1, a vehicle designated generally by reference numeral 10, has two outrigger pedestals 12 and 14 which stabilize the vehicle against overturning in the various angular positions and operative positions of a mobile vertically raiseable platform 16 having an occupant therein. The platform 16 (or basket, as it is sometimes referred to) is mounted at end 18 of a pair of articulated booms, an upper boom 20 and a lower boom 22 which are pivotally joined at 24. Lower boom 22 is in turn mounted on a turntable 26 so that platform 16 can be raised and lowered and located in a variety of different vertical positions by coordinated actuation of a power cylinder 28 which effects angular movement of the upper boom 20 about 24, a second power cylinder 30 which rotates lower boom 22, and therefore the upper boom 20, about pivot 32 and both booms are in turn movable angularly about a vertical axis through a turntable 26 having an associated fluid actuator (not shown).

Each of the fluid motor actuators 28,30 and the one associated with the turntable 26 are controllable from control means located in the basket 16, the general arrangement for this being fully disclosed in my copending application Ser. No. 746,611 titled, "IMPROVED ACTUATOR FOR HYDRAULIC SYSTEMS IN TRANSPORTABLE MOBILE PLATFORMS", filed Dec. 22, 1976, and assigned to the same assignee as the present application.

The actuator system sometimes positions the upper boom 20 in relation to the lower boom 22 so that, because of the perpendicularity or near perpendicularity of the upper boom 20 there is created a dangerously unstable condition for the upper boom 20. In other words, should the upper boom 20 be disposed in a near perpendicular position, it is difficult to control and presents real possibilities of becoming "over center" in relation to the lower boom 22. In that condition, it is not only difficult to control the upper boom but there is a possibility of overbalancing the vehicle 10 in spite of the pedestals 12,14.

The point of the invention is to preclude movements of the upper boom 20 beyond certain angular limits which approach perpendicularity of the upper boom 20 relative to the horizon. The objectionable perpendicularity can arise in either of two distinct manners: (a) the actuator 28 can move the boom 20 above certain acceptable limits of perpendicularity by effecting angular movement of 20 about 24 (clockwise, FIG. 1) or, (b) in a given angular position of boom 20, as for example in the dotted line position shown in FIG. 1, lowering (clockwise movement) of the lower boom 22 about 32 can bring the upper boom 20 into objectionable angles of perpendicularity relative to the horizon.

The present invention is intended as a means for limiting actuation of the hydraulic actuator 28 so that the upper boom 20 cannot be brought into raising position beyond prescribed perpendicularity and likewise the present invention limits actuation of the hydraulic actuator 30 to cause lowering movements of the lower boom 22 which could likewise effect an objectionable degree of perpendicularity of the upper boom 20 to the horizon.

Figure 2:
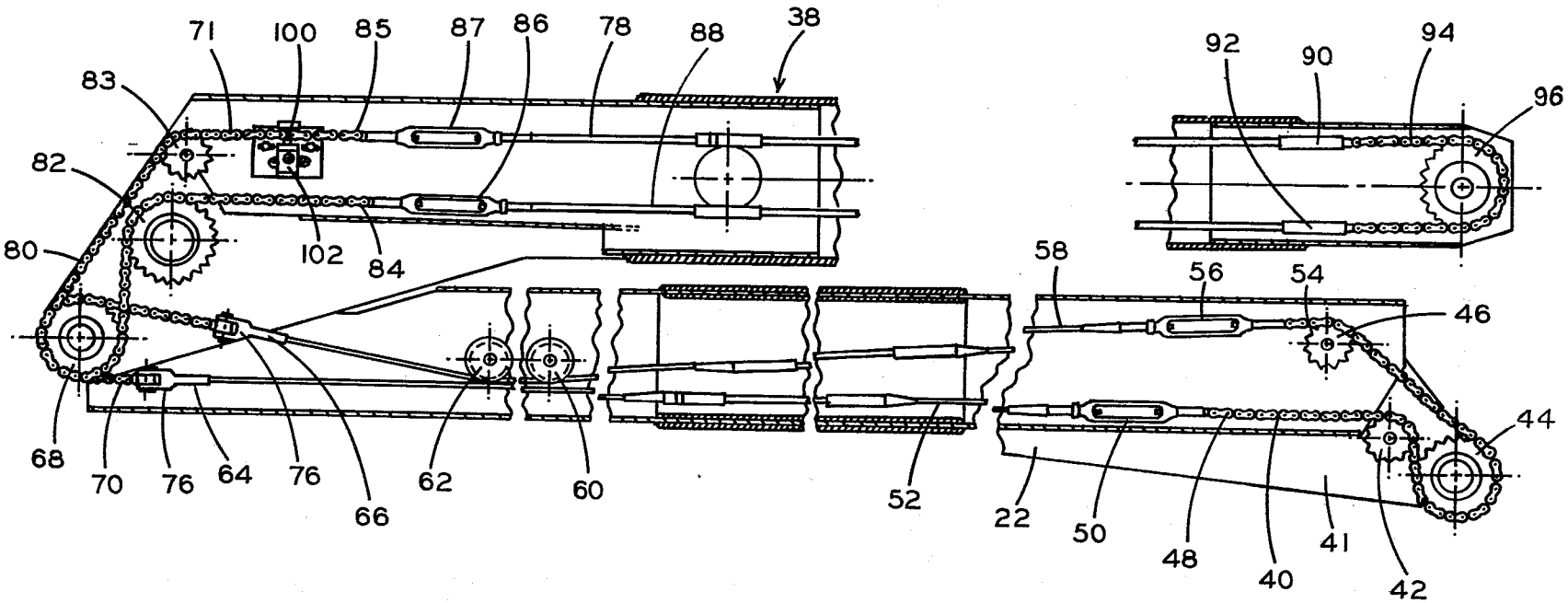
FIG. 2 is a section view of the articulated booms one over the other and illustrating the leveling system and the actuator incorporated within a portion of the leveling system in accordance with the present invention.

How this is accomplished will be next explained:

Referring to FIG. 2, there is presently within the upper and lower booms what is known as a leveling system designated generally by reference numeral 38 and the purpose of which is to keep the basket or platform 16 oriented horizontally regardless of the angular positions of the booms 20,22. The leveling system consists of a chain 40 at lower end 41 of lower boom 22, this chain being passed over sprocket wheels 42,44 and 46, and having at end 48 a turn-buckle connection 50 with a glass rod 52 and at the other end 54, a turn-buckle 56 connection with glass rod 58. Intermediate pulley wheels 60,62 insure the proper positioning of the rods. Ends 64,66 have one chain 70 passing over sprocket wheel 68 and connecting at 74 with adapters 76 on rods 52. The other chain 80 is wrapped over sprocket wheel 68, a second sprocket wheel 82 and a third sprocket wheel 83 and connects at end 84 with a turn-buckle 86 and glass rod 88, while the other end 85 connects through turn-buckle 87 with rod 78. The two rods 78,88 connect respectively at ends 90,92 with a chain 94 passing over sprocket wheel 96.

Figure 3:
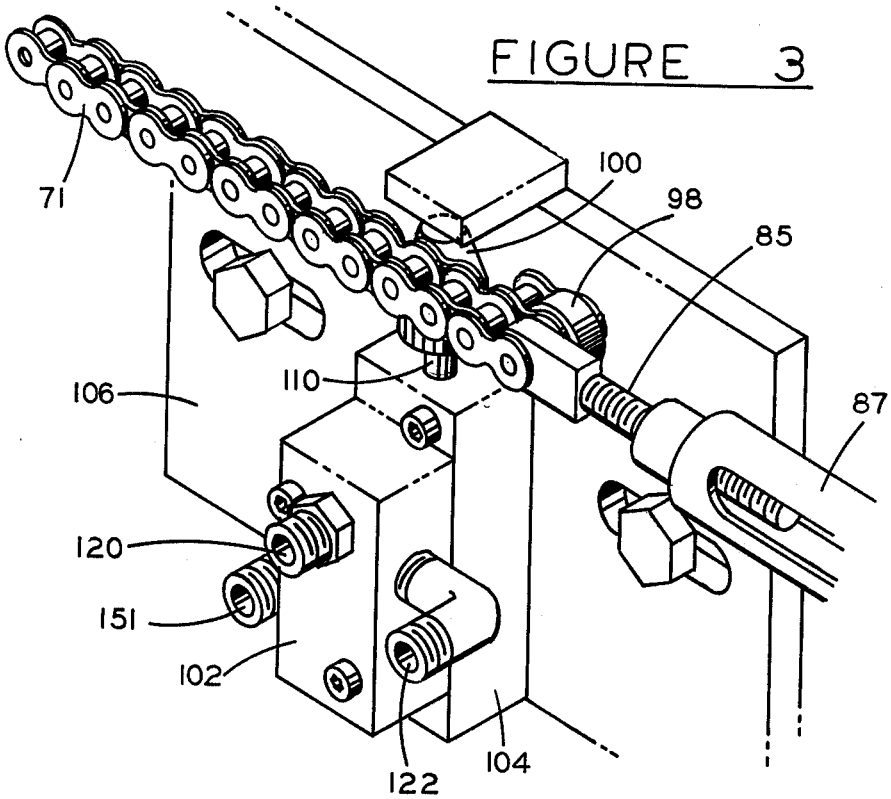
FIG. 3 is an enlarged isometric view illustrating how the leveling system is used as an actuator for the present invention.

The leveling system thus described is effective for maintaining the basket or platform 16 at a level condition no matter what the angular positions of the upper 20 and lower 22 booms, and the relationship of sprocket wheels 44 and 96 is such that the same angular position of the two wheels 44 and 96 is maintained constantly. This relationship can be used advantageously in that movement of the chain section 71 is related to the degree of movement at the upper boom and is also related to the degree of perpendicularity of the upper boom. Thus, the chain section 71 has a direct mathematical relationship to the perpendicularity of the upper boom in that as the upper boom 20 moves from horizontal to positions approaching perpendicularity, whether such position is obtainable by swinging the upper boom 20 about 24 or lowering the lower boom 22 about 32, both will result in the same direction of movement of the chain section 71 and at the same critical angle of perpendicularity, whether achieved by actuation of the upper boom 20 or lower boom 22 chain 71 movement can be calibrated to move a cam 98 (FIG. 3) into contact with a cam follower 100 which operates control valve 102 within valve housing 104 mounted on bracket 106.

Figure 7:
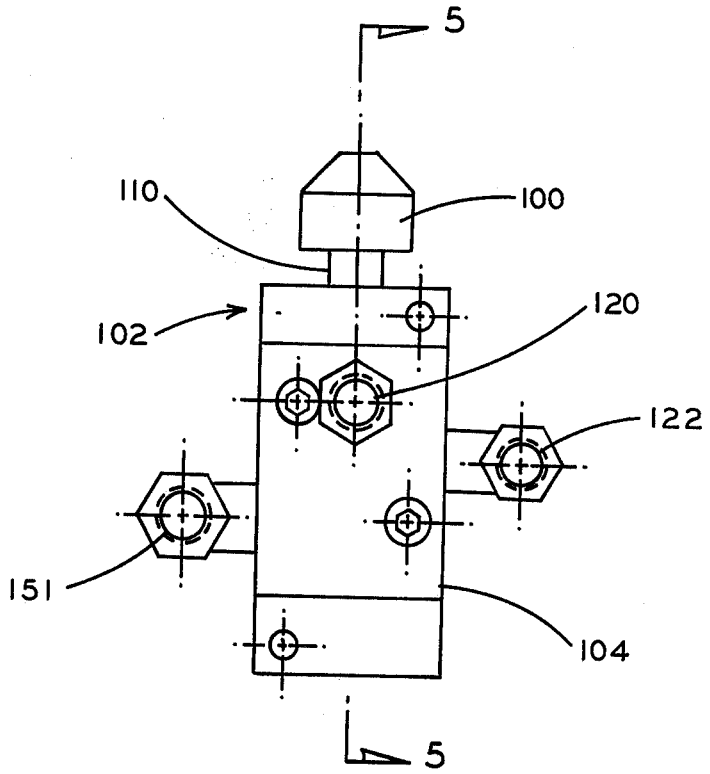
FIG. 7 is a side elevation view of the valve viewed from the right-hand side and looking in the direction of the arrows 7—7 in FIG. 5.
Figure 5:
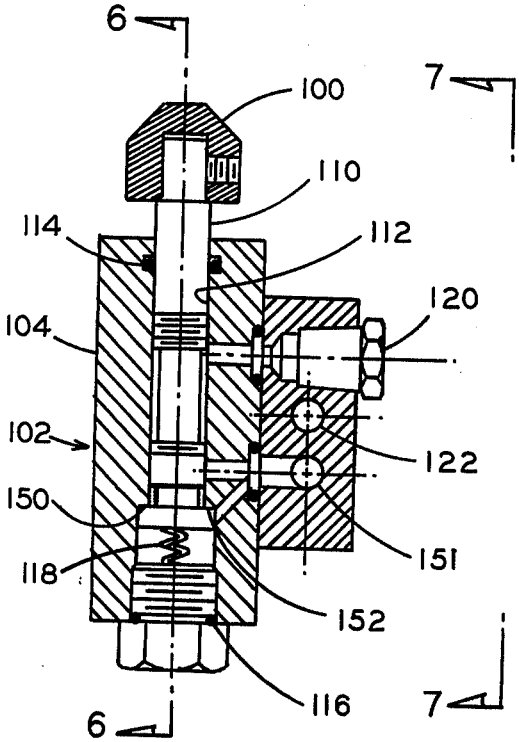
FIG. 5 is a section view taken through the center of the control valve.
Figure 6:
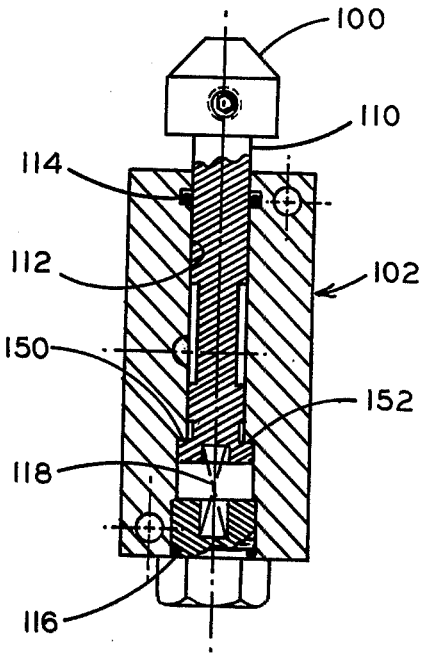
FIG. 6 is a transverse sectional view taken at right angles to the section view of FIG. 5.

Referring to FIGS. 5–7 cam follower 100 is mounted on the end of valve stem 110 which is reciprocally mounted within a bore 112 having O ring seals 114 and 116. The valve stem is biased by a spring 118 to the normal position shown in FIG. 5 such that the main hydraulic pressure line 120 is communicated through the bore 112 through line 122 either by branch line 124 and check valve 126 through line 128 to the variable volume chamber 130 below power piston 132 of power cylinder 30 associated with lower boom 22 or through branch line 136 past check valve 138 to line 140 and thence to variable volume chamber 142 of power cylinder 28 associated with the upper boom 20. Thus, in the position of the control valve shown in FIG. 5 with the spring 118 biasing the valve to its normal position and with shoulder 150 against annular stop 152, main pressure is communicable to chamber 130 of power actuator 30 and chamber 142 of power cylinder 28. The bore 112 has a fluid connection 151 with return line 152 which includes the ball check valve 154.

While the main pressure line 156 (FIG. 4) is connected through line 120 in valve 112 through line 122 and branch lines 124 and 126 with chamber 130 of power cylinder 30 and chamber 142 with power cylinder 20, these being the fluid connections which are effective to move the basket 16 and theupper boom 20 and lower boom 22 toward perpendicularity of the upper boom 20, the main pressure line 156 includes an extension line 158 and port 160 connecting with post 161 and line 162 past check valve 164 to the variable volume chamber 166 and the power cylinder 30 associated with the lower boom. The port 160 is connected to the upper boom port 168 and port 170 through line 172 and to the variable volume chamber 174 associated with the upper boom actuator 28.

Figure 4:
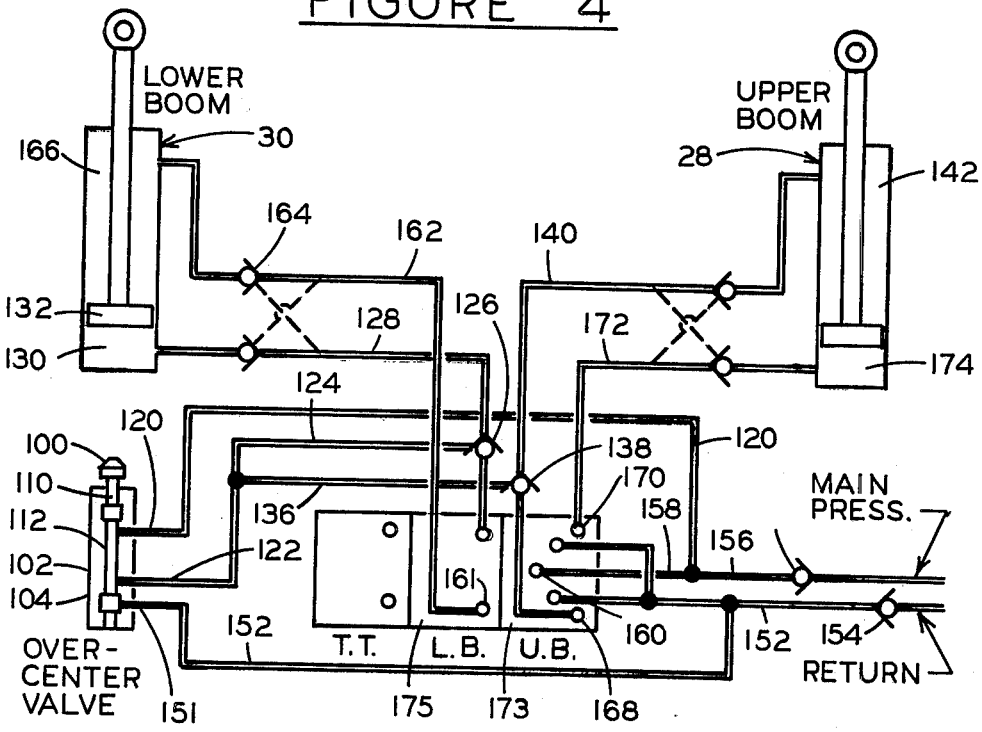
FIG. 4 is a schematic of the hydraulic system for controlling the actuators for the upper and lower booms and how the present invention is incorporated therein.

As shown in FIG. 4, the upper boom 173 and lower boom 175 valves are effective for communicating main pressure line 156 to chamber 166 of power cylinder 30 and chamber 174 of power cylinder 28 of the upper boom 30 so that the upper boom actuator 28 can counter-rotate upper boom 20 about pivot 24 to lower the basket 16 and power cylinder 30 can rotate lower boom 22 about its pivot 32 in a counter-clockwise direction (FIG. 1) both of which tend to reduce the perpendicularity of the upper boom 20 and independently of any operation of the control valve 102. Thus, even should the operator of the basket or platform 16 inadvertently produce movement of the upper boom 20 into objectionable perpendicular position, the controls which are available at the basket are still effective through the main pressure line through the upper boom valve 173 and lower boom valve 175 to produce fluid pressure connections from the main pressure line 156 to variable volume chamber 166 or to variable volume chamber 174 independently of the control valve 102 to properly adjust the position of the basket 16. On the other hand, should the basket 16 and boom 20 be at or in excess of the critical perpendicular emplacement, the platform 16 can nevertheless be independently actuated through a "less than critical value" by actuation of power cylinder 28 or power cylinder 30.

OPERATION OF THE DEVICE

In operation, the vehicle or truck is brought to the site of operation and outriggers 12 and 14 are extended. The operator in the platform or basket 16 then utilizes controls of the type illustrated in co-pending application Ser. No. 720,569 filed Sept. 7, 1976, titled, "IMPROVED FLUID CONTROL SYSTEM", and assigned to the same assignee as the present application. The two fluid motor actuators 28,30, associated with the upper boom 20 and lower boom 22, as well as the fluid motor actuator in connection with the turntable 26 cause the basket to move vertically, horizontally, and laterally to the correct position. Controls in the basket are of the type previously alluded to in reference to my application Ser. No. 746,661 (supra). As the boom 20 is rotated clockwise about 24, it gradually approaches a condition of perpendicularity to the horizon. For purposes of illustration, the present invention precludes movement of upper boom 20 in excess of 75° to the horizon. At 75° to the horizon, further movement of the upper boom 20 is prevented by operation of the control valve 102. It should be understood that movements of the upper boom 20 into perpendicularity are dependent not only upon operation of the fluid motor actuator 28 causing clockwise rotation of the boom 20 about 24 (FIG. 1), but also upon clockwise movement of the lower boom 22 by the fluid motor actuator 30 about pivot 32 (see dotted line, boom positions FIG. 1). In this case, the actuation of the power cylinder 30 in a direction permitting clockwise movement of the lower boom 22 about 32 can likewise bring the upper boom 20 into the objectionable 75 or greater than 75° of perpendicularity to the horizon. These conditions are prevented because, in reference to FIG. 2, the cog wheel 44 associated at the base or lower end of the boom 22 is synchronized with the cog wheel 96 at the upper or free end of the upper boom 20 and the two are caused to move together in a coordinated sense. When the 75° position is approached, the cam 98 (FIG. 3) which is adjacent to turn-buckle 87, comes into contact with the cam follower 100, and the valve 102 prevents further movement of either the power cylinder 28 or power cylinder 30, causing further perpendicularity. How that is achieved will be next described.

Referring to FIG. 4, should the control valve 102 not be operated by the cam follower 98, fluid pressure in line 122 corresponds to main pressure and that same pressure in lines 124,136 hold open valves 126,138, permitting main pressure to be communicated to chamber 130 or 142 through valves 126,138 and in accordance with operation of upper boom valve 173 and lower boom valve 175. If line 122 is communicated to return line 152 by operation of cam 100 then from cam follower 98, then loss of pressure results in lines 124,136 which are communicated to tank and this causes valves 126,138 to close, thus prohibiting main pressure communication with chamber 130 or chamber 142 through control valves 173,175.

It should be noted that lowering movement of the upper boom 20 by counterclockwise rotation on pivot support 24 or clockwise rotation of the lower boom 22 about 32 is at no time prevented since pressure from main pressure line 156 is communicated to chambers 166 in power cylinder 30 and chamber 174 of power cylinder 28 without going through the control valve 102. Pressure in this case is regulated directly by the upper boom control valve 173 and lower boom control valve 175.

Once cam 98 is moved away from cam follower 100, the valve stem 110 is biased upwardly by the spring 118 to its normal position shown in FIG. 5 and the normal operation of the upper and lower boom actuators associated with the upper and lower booms respectively can proceed as before.

As indicated from the explanation of operation, control valve 102 is operated by a follower which is part of the leveling system associated with the basket 16 so that no additional construction has to be added in the way of operating the control system. This is a substantial advantage of the present invention in that the control system is incorporated into the existing boom actuator system and leveling system.

Also, it is not essential to locate the control valve in any one particular location in the upper boom so long as the control valve is positioned to be actuated by a portion of the leveling system which moves responsively to upper boom movement and, more importantly, to position of the upper boom in its perpendicularity to the horizon.

It is possible by controlling the position of the control valve 102 to determine the exact perpendicularity of the upper boom before further operation is precluded. For example, the upper critical angle can be made 80,85 degrees, whatever is desired, and such angle can be adjusted according to the selected positioning of the valve body.

Although the present invention has been illustrated and described in connection with a single example embodiment, it will be understood that this is illustrative of the invention and is by no means restrictive thereof. It is reasonably to be expected that those skilled in this art can make numerous revisions and adaptations of the invention and it is intended that such revisions and adaptations will be included within the scope of the following claims as equivalents of the invention.

What is claimed is:

1. In a mobile lift platform having a pair of articulated booms, a first rotary member at the base of the first of said booms, a second rotary member associated with the free end of the upper articulated boom, elongated flexible means for positively interconnecting the two said rotary members whereby the upper rotary member by its angular position is calibrated in terms of the upper boom location relative to the horizon, actuator means operatively connected to said means interconnecting said upper and lower rotary members, valve means responsive to said actuator means and adapted to effect the discontinuance of movement of either the upper or lower booms in a direction effecting upper boom angularity approaching perpendicularity to the horizon, and power means for effecting independent movement of the upper and lower booms respectively and responsive to said valve.

2. The construction in accordance with claim 1 including fluid pressure control means adapted to independently actuate said power means for effecting movement of both the upper and lower booms in a direction retracting the upper boom from its prior limited position.

3. The apparatus in accordance with claim 1 including pressure supply means having fluid connections, pressure connections with said upper and lower boom actuator means and effective for displacement of the boom in a direction reducing the perpendicularity of the upper boom from its critical position independently of the valve means which determines the critical maximum perpendicularity of the upper boom position relative to the horizon.

4. The apparatus in accordance with claim 1 in which said means for interconnecting the upper and lower rotary members is constituted by a combination of a flexible chain and rod means.

5. The apparatus in accordance with claim 4 including a movable cam, and a cam follower forming a part of said valve means whereby movement of the chain and rod will effect operation of the valve as a function of the perpendicularity of the upper boom relative to the horizon.

6. The apparatus in accordance with claim 1 in which said valve means includes a valve spool, spring means biasing said valve spool to a normal position, and port means for venting the fluid pressure from the power actuator means associated with the upper and lower booms respectively at a predetermined critical perpendicular angle of the upper boom to the horizon and limiting further movement of said upper boom beyond its critical perpendicularity while maintaining non-interference with power actuator means effecting upper and lower boom movements in a direction reducing such critical perpendicularity of the upper boom by movement of either the upper or lower booms respectively.

* * * * *